US007008245B1

(12) United States Patent
Chien

(10) Patent No.: US 7,008,245 B1
(45) Date of Patent: Mar. 7, 2006

(54) CARD CONNECTOR

(75) Inventor: Hsu-Pin Chien, Shulin (TW)

(73) Assignee: L & K Precision Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/989,369

(22) Filed: Nov. 17, 2004

(51) Int. Cl.
*H01R 13/62* (2006.01)

(52) U.S. Cl. ..... 439/159

(58) Field of Classification Search ..... 439/155, 439/156, 157, 158, 159, 160, 328, 327, 372; 361/754

See application file for complete search history.

(56) References Cited

U.S. PATENT DOCUMENTS 5,899,763 A * 5/1999 Kajiura ..... 439/159
6,045,377 A * 4/2000 Kajiura ..... 439/159
6,059,588 A * 5/2000 Tung et al. ..... 439/159
6,113,403 A * 9/2000 Oguchi ..... 439/159
6,155,853 A * 12/2000 Kajiura ..... 439/159
6,319,029 B1 * 11/2001 Nishioka ..... 439/159
6,482,020 B1 * 11/2002 Yeh ..... 439/159
6,520,784 B1 * 2/2003 Ito et al. ..... 439/159

* cited by examiner

*Primary Examiner*—Chandrika Prasad
(74) *Attorney, Agent, or Firm*—Troxell Law Office, PLLC

(57) ABSTRACT

A card connector has an insulative frame, a plurality of conductive terminals received in the insulative frame, an eject device assembled on the insulative frame and a shell covering the insulative frame. The eject device includes a driving rod, a driven shaft, a driven sleeve, a slider and a resilient element. The driving rod axially defines a 90 degree first continuous chute, and the driven shaft axially defines a 90 degree second continuous chute for meshing with the first continuous chute. The driven sleeve is fixed on the insulative frame and telescopically meshes with the driven shaft. The slider is cantileveredly mounted on the driving rod. During insertion of the card, the driving rod drives the driven shaft to rotate. A stop block of the driven sleeve disengages from an abutting portion of the slider, and thereafter engages with a wedging hole of the card. Thus, the card in final position is protected against exterior reverse shock.

10 Claims, 6 Drawing Sheets

CARD CONNECTOR

BACKGROUND OF THE INVENTION

1. Field of the Invention

The present invention relates to a card connector, and particularly to a card connector which is used to communicate between an electronic card and a mainboard and which allows the card inserted in or ejected out only by pressing the electronic card.

2. Related Art

Push—Push type connectors are often used to communicate between an electronic card and a mainboard, which allows the card inserted in or ejected out only by pressing the electronic card. U.S. Pat. No. 6,520,784 discloses such a card connector. The card connector includes a connector body receiving a plurality of terminals therein, an eject device assembled on the connector body for guiding an electronic card inserted in or ejected out, and a metal shell for covering the housing. However, the electronic card cannot be fixed when it is received in the eject device. Especially under undesired environment or exterior shock, the card tends to displace, resulting in improper contact between the conductive terminals and the mainboard and even unstable signal transmission. Additionally, in such a design, the conductive terminals are apt to wear down.

SUMMARY OF THE INVENTION

Accordingly, an object of the present invention is to provide a card connector which guides an electronic card inserted in or ejected out and which firmly retains the card when the card reaches a predetermined final position thereby effectively protecting from exterior shock and assuring reliable signal transmission.

The card connector comprises an insulative frame, a plurality of conductive terminals received in the insulative frame, an eject device assembled on the insulative frame and a shell covering the insulative frame.

The eject device includes a driving rod, a driven shaft, a driven sleeve, a slider and a resilient element. The driving rod axially defines a 90 degree first continuous chute. The driven shaft axially defines a 90 degree second continuous chute for meshing with the first continuous chute, whereby the driven shaft displaces relative to the driving rod along the meshing trace to position the card. An L-shaped link arm is formed on the driving rod and opposite to the first continuous chute. a first embedding groove is radially distributed in an outer peripheral of the driven shaft.

The driven sleeve is fixed on the insulative frame and telescopically connects with the driven shaft. A second embedding groove is radially distributed in an outer peripheral of the driven sleeve for meshing with the first embedding groove. A stop block is formed on the driven sleeve and opposite to the driven shaft.

The slider is cantileveredly mounted on the driving rod. An abutting portion is formed at a free end of the slider and near the stop block of the driven sleeve for abutting the stop block when assembled together. During insertion of the card, the driving rod drives the driven shaft to rotate. The stop block of the driven sleeve, which abuts the abutting portion of the slider in normal state, disengages from the abutting portion, and thereafter engages with a wedging hole of the card. Thus, the card in the final position is protected against exterior reverse shock.

DESCRIPTION OF THE PREFERRED EMBODIMENTS

Figure 1:
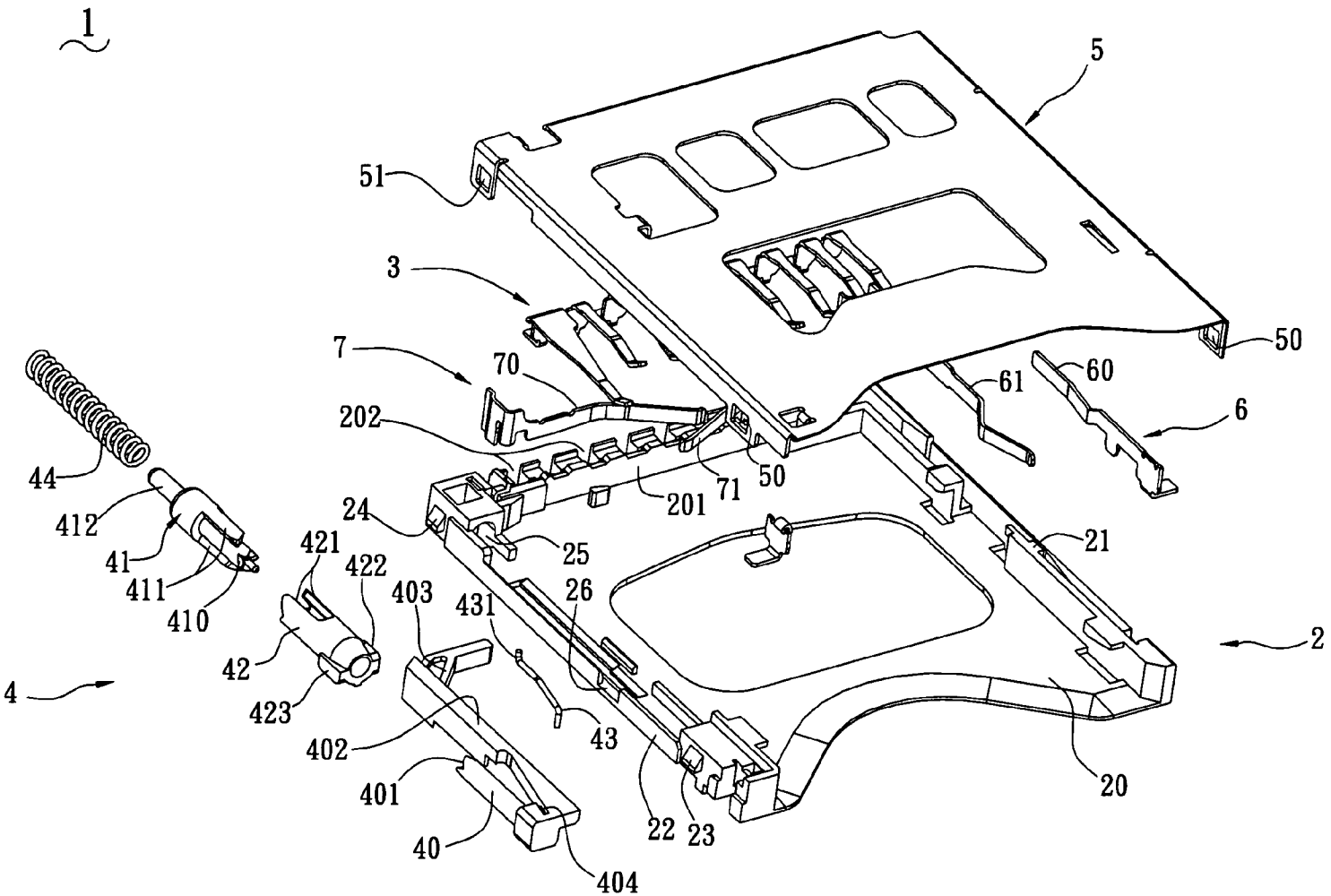
FIG. 1 is an exploded view of a card connector of the present invention.
Figure 2:
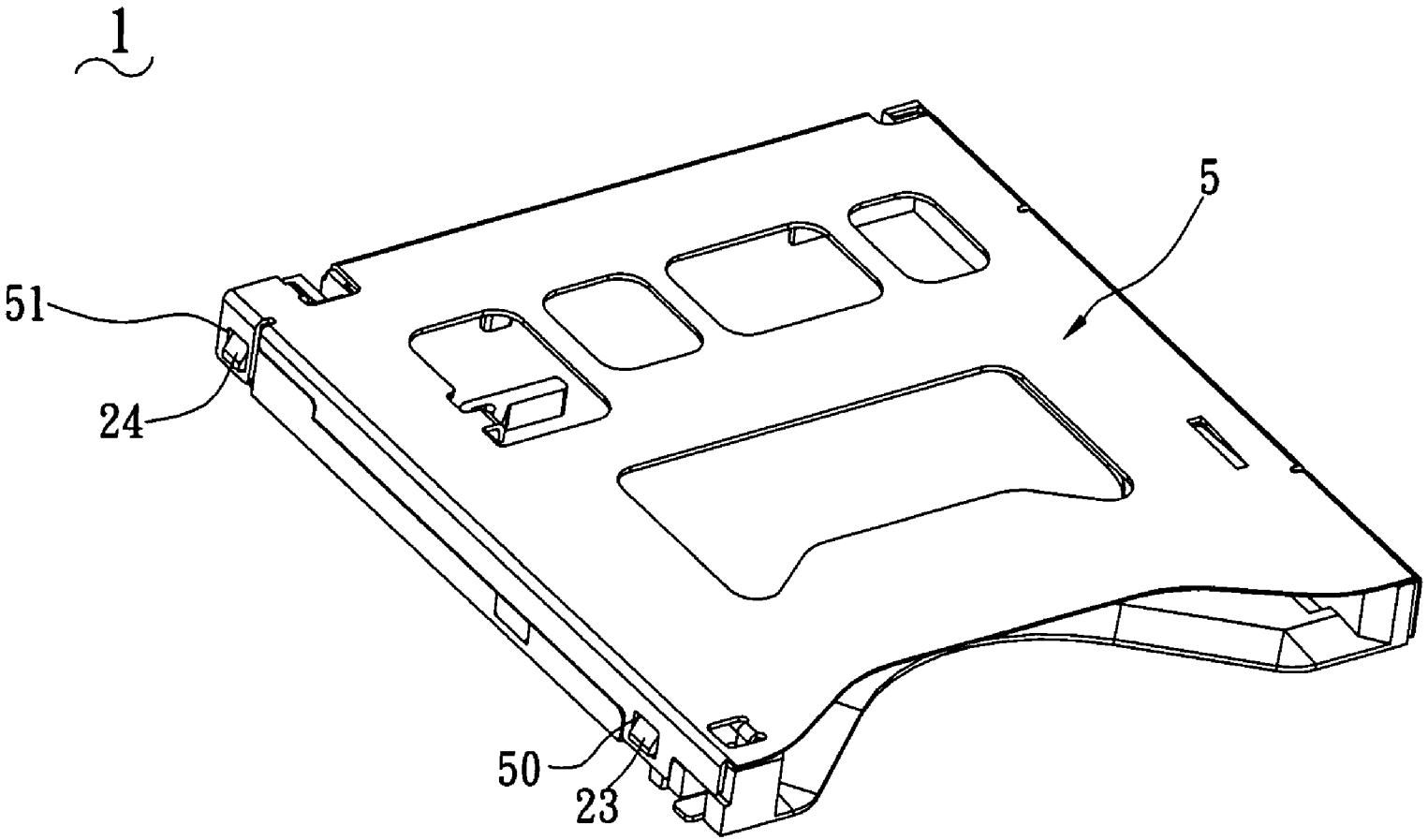
FIG. 2 is an assembled view of the card connector of FIG. 1.

With reference to FIG. 1, a card connector 1 of the present invention comprises an insulative frame 2, a plurality of conductive terminals 3 received in the insulative frame 2, an eject device 4 and a shell 5.

Figure 4:
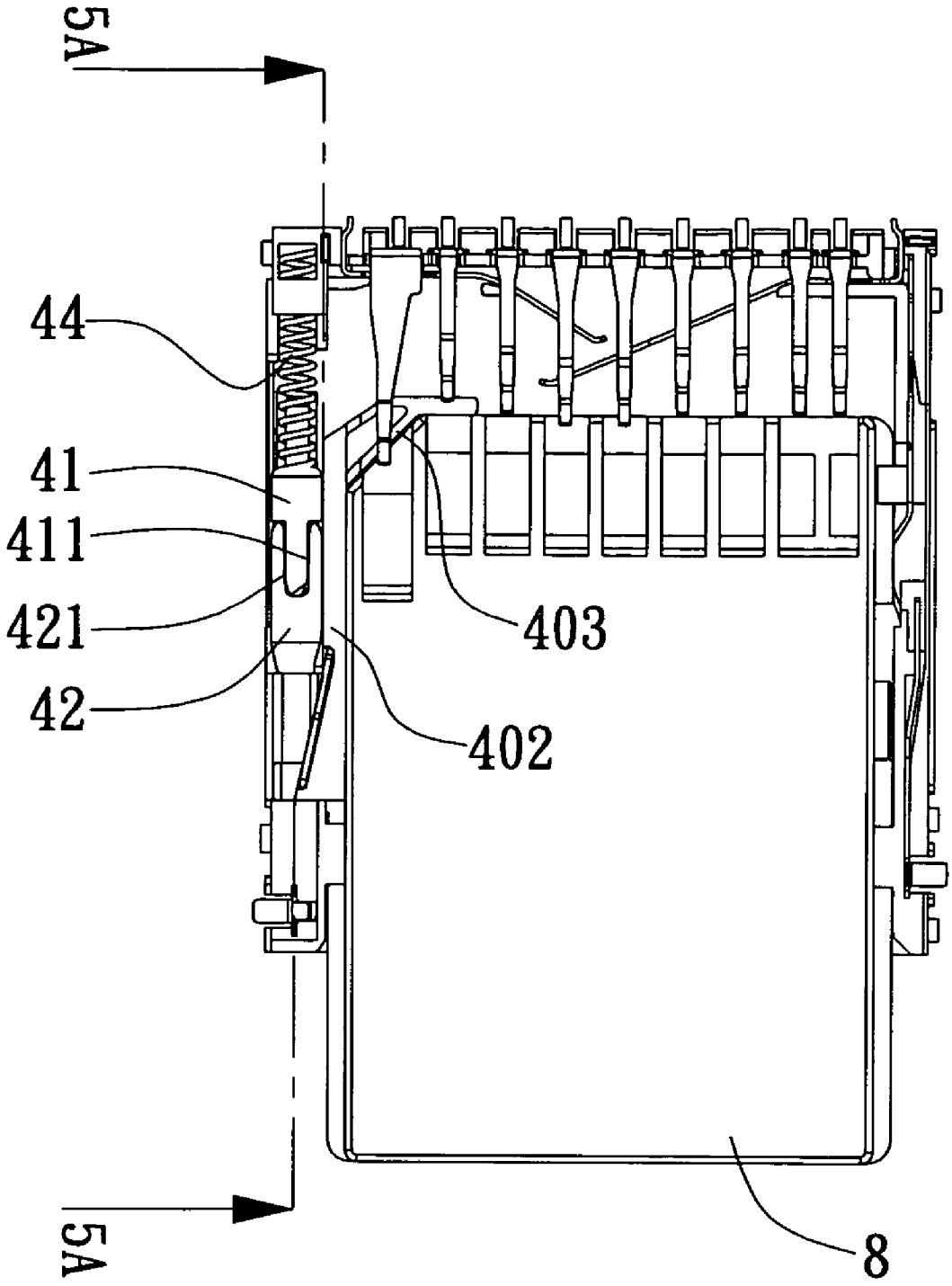
FIG. 4 is a top view of the card connector, wherein a shell thereof is removed.

The insulative frame 2 includes a housing 20 and a pair of side posts 21, 22 at opposite sides of the housing 20. The housing 20 forms a bottom post 201, and defines a plurality of passageways 202 in the bottom post 201 for receiving the conductive terminals 3 therein. The side posts 21, 22 and the bottom post 201 borders a receiving slot (not labeled) for accommodating an electronic card 8 (shown in FIG. 4) therein. A first switch 6 is mounted on the housing 20 for write-protect enabling of the card 8. The first switch 6 has a pair of spring sheets 60, 61 which are constantly open in normal state. Namely, when assembled, the spring sheets 60, 61 do not contact each other until the card 8 is inserted to provide pressure. A second switch 7 is mounted on the housing 20 and adjacent to the eject device 4 for enabling the communication between the card connector 1 and the electronic card 8. The second switch 7 has a pair of spring sheets 70, 71 which are constantly open in normal state. The side posts 21, 22 form latches 23, 24 on outer sides thereof. The shell 5 has locking holes 50, 51 for corresponding to the latches 23, 24 thereby retaining the shell 5 on the insulative frame 2. A ditch 26 is defined in the side post 22 of the insulative frame 2.

The eject device 4 is assembled on the side post 22, and includes a driving rod 40, a driven shaft 41, a driven sleeve 42, a slider 43 and a resilient element 44.

The driving rod 40 axially defines a 90 degree first continuous chute 401. An L-shaped link arm 402 is integrally formed with the driving rod 40 and opposite to the first continuous chute 401. The L-shaped link arm 402 forms a 45 degree inclined surface 43 at an inner edge of the cross thereof against misplug of the card 8. A fixing groove 404 is defined between the L-shaped link arm 402 and the driving rod 40 for cantileveredly fixing an end of the slider 43 thereby enhancing resiliency of the slider 43.

The driven shaft 41 axially defines a 90 degree second continuous chute 410 for meshing with the first continuous chute 401. A first embedding groove 411 is radially distributed in an outer peripheral of the driven shaft 41. The driven shaft 41 forms a fixing post 412 at an end thereof and opposite the second continuous chute 410. In this embodiment, the resilient element 44 is a compressed spring. The resilient element 44 is mounted around the fixing post 412 and is accommodated in a positioning slot 25 (referring to FIG. 1) of the insulative frame 2 for providing return force of the driven shaft 41.

A driven sleeve 42 is fixed on the driven shaft 41. A second embedding groove 421 is radially distributed in an outer peripheral of the driven sleeve 42 for meshing with the first embedding groove 411, whereby the driven sleeve 42 telescopically connects with the driven shaft 41. A stop block 422 is formed on the driven sleeve 42 and opposite to the driven shaft 41. The driven sleeve 42 forms a tab 423 thereon for corresponding to the ditch 26 thereby fixing the driven sleeve 42 on the insulative frame 2. The slider 43 is cantileveredly mounted on the fixing groove 404 of the driving rod 40. An abutting portion 431 bends perpendicularly from at a free end of the slider 43 and near the stop block 422 of the driven sleeve 43 when assembled. In assembly, as shown in FIG. 5, the abutting portion 431 abuts the stop block 422. When the driven shaft 40 is pushed to displace, the abutting portion 431 is spaced from the stop block 422, and consequently the slider 43 returns to a wedging hole 80 of the card 8 by preserved energy.

Figures 3A, 3B, 3C:
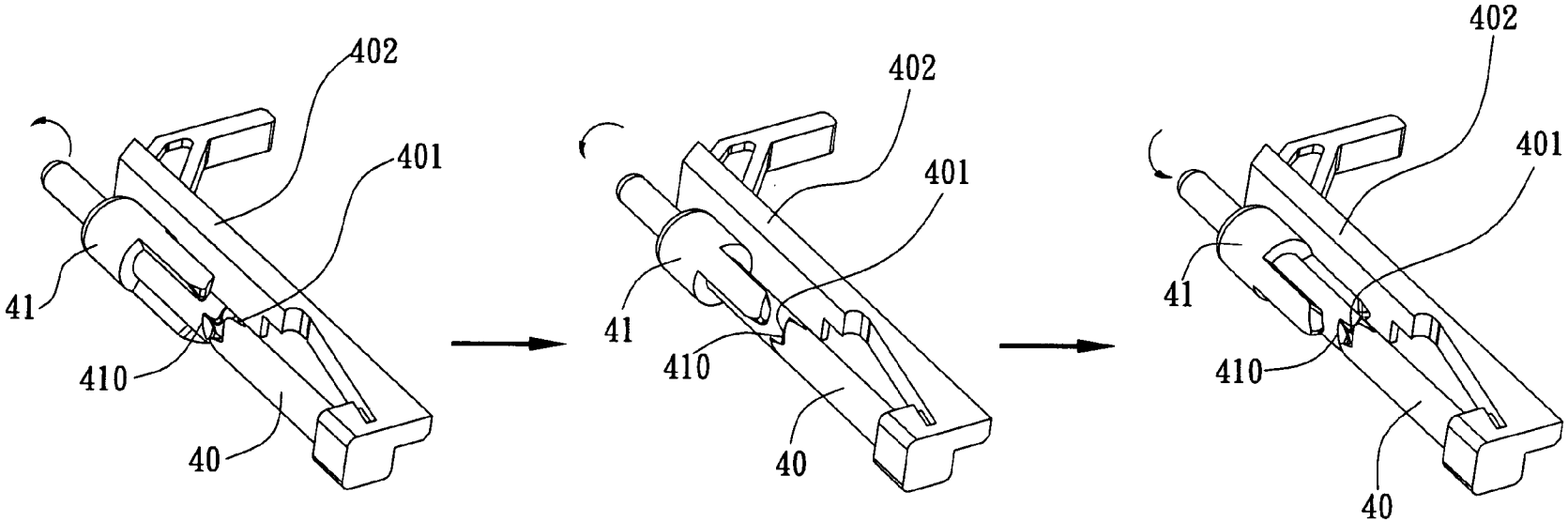
FIGS. 3A–3C are schematic diagrams of consecutive operations of a driving rod and a driven shaft of the card connector of FIG. 1.
Figure 6:
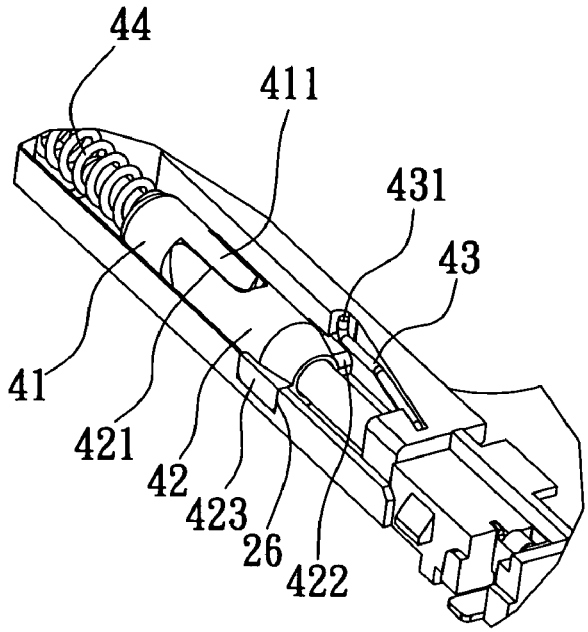
FIGS. 6–7 are schematic diagrams of a slider, which is driven by the driving rod at different positions.
Figure 7:
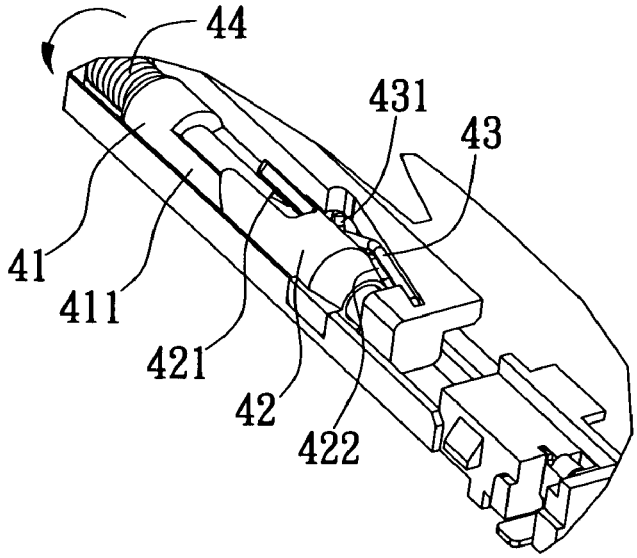

Referring to FIGS. 3A–3C and FIGS. 6 and 7, the first continuous chute 401 meshes with the second continuous chute 410, whereby the driving rod 40 and the driven shaft 41 operate with each other. The card 8 pushes the L-shaped link arm 402, and correspondingly the driven shaft 41 is pushed transversely and simultaneously rotates along meshing trace of the first continuous chute 401 and the second continuous chute 410, as the arrow in FIGS. 3A–3C. When the card 8 reaches a final position, the first embedding groove 411 turns back, and thereafter disengages from the second embedding groove 421 of the driven sleeve 42, as shown in FIG. 7. Meanwhile, the resilient element 44 pushes the driven shaft 41 and the driving rod 40 back owing to return force thereof, as shown in FIG. 3A. To eject the card 8, when pressing the card 8, the driving rod 40 displaces toward driven shaft 41. The driven shaft 41 rotates simultaneously with the first continuous chute 401 and the second continuous chute 410 meshing with each other (referring to FIG. 3B). Correspondingly the first embedding groove 411 turns back and engages with the second embedding groove 421. When the card 8 is ejected out, the resilient element 44 pushes the driven shaft 41 and the driving rod 40 back due to return force thereof (referring to FIG. 3C).

Figure 5A:
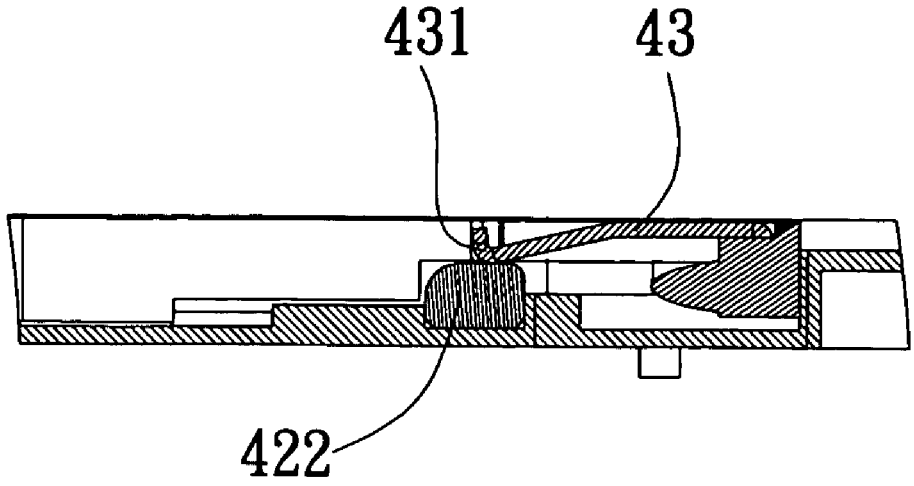
FIG. 5A is a sectional view taken along the line in FIG. 4.
Figure 5B:
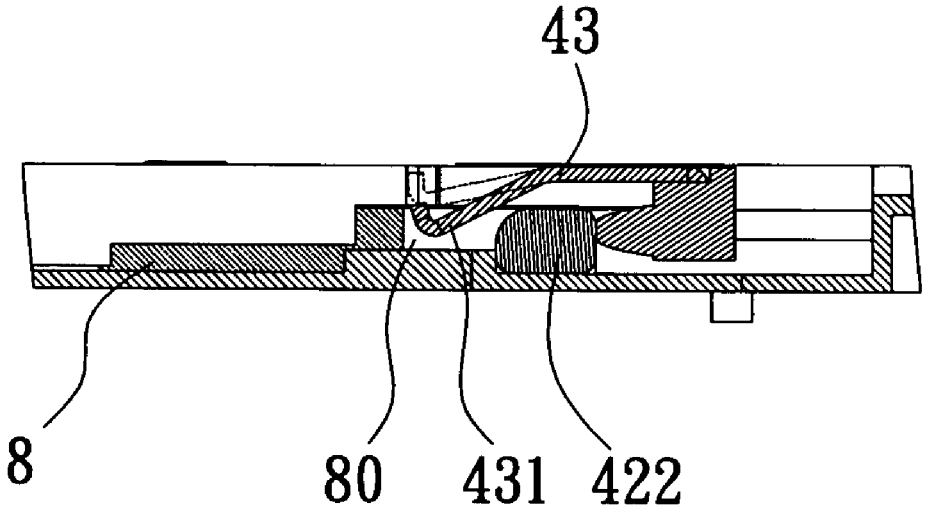
FIG. 5B is a schematic diagram of operation of FIG. 5.

Further referring to FIGS. 4, 5A, 5B, 6 and 7, when the card 8 is inserted into the card connector 1, the inclined surface 403 of the L-shaped link arm 402 engages a corner of the card 8 to position the card 8 properly. During insertion of the card 8, the driving rod 40 drives the driven shaft 41 to rotate. The stop block 422, which abuts the abutting portion 431 of the slider 43 in normal state, disengages from the abutting portion 431, as shown in FIGS. 5A and 6, and thereafter engages with the wedging hole 80 of the card 8, as shown in FIGS. 5B and 7. Thus, the card 8 in final position is protected against exterior reverse shock, thereby assuring stable signal transmission. Because of the contact of the spring sheets 60, 61 and the contact of the spring sheets 70, 71, the card 8 can activate the functions of write-protect enabling and positioning prompt.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A card connector for allowing an electronic card inserted in or ejected out by pressing the card, comprising:

an insulative frame having a housing and a pair of side posts at opposite sides of the housing, a plurality of passageways being defined in the housing for receiving conductive terminals therein, the side posts and the housing bordering a receiving slot for receiving the card;

an eject device assembled on one of the side posts, including:

a driving rod axially defining a 90 degree first continuous chute, an L-shaped link arm being formed opposite to the first continuous chute;

a driven shaft axially defining a 90 degree second continuous chute for meshing with the first continuous chute, a first embedding groove being radially distributed in an outer peripheral of the driven shaft;

a driven sleeve fixed on the insulative frame, and telescopically connecting with the driven shaft, a second embedding groove being radially distributed in an outer peripheral of the driven sleeve for meshing with the first embedding groove, a stop block being formed on the driven sleeve and opposite to the driven shaft;

a slider cantileveredly mounted on the driving rod, and having an abutting portion at a free end thereof and near the stop block of the driven sleeve for abutting the stop block when assembled; and a resilient element mounted on the driven shaft and opposite the second continuous chute for providing return force of the driven shaft; and a shell assembled on a top of the insulative frame and covering the housing and the side posts.

2. The card connector as claimed in claim 1, wherein the L-shaped link arm is integrally formed with the driving rod, and the L-shaped link arm forms a 45 degree inclined surface at an inner edge of a cross thereof against misplug of the card.

3. The card connector as claimed in claim 2, wherein a fixing groove is defined between the L-shaped link arm and the driving rod for cantileveredly fixing an end of the slider.

4. The card connector as claimed in claim 1, wherein the driven shaft forms a fixing post at an end thereof and opposite to the second continuous chute.

5. The card connector as claimed in claim 4, wherein the resilient element is a compressed spring mountable around the fixing post of the driven shaft.

6. The card connector as claimed in claim 1, wherein the abutting portion bends perpendicularly from the free end of the slider.

7. The card connector as claimed in claim 1, further comprises a first switch mounted on the housing for enabling the card connector communicating with the electronic card, and wherein the first switch has a pair of spring sheets constantly close or open in normal state.

8. The card connector as claimed in claim 1, further comprises a second switch on the housing and adjacent to the eject device for enabling the communication between the card connector and the electronic card, and the second switch has a pair of spring sheets constantly close or open in normal state.

9. The card connector as claimed in claim 1, wherein the shell has locking holes, and the insulative frame forms latches for locking the locking holes thereby retaining the shell on the insulative frame.

10. The card connector as claimed in claim 1, wherein the insulative frame has a ditch, and the driven sleeve forms a tab thereon for corresponding to the ditch thereby fixing the driven sleeve on the insulative frame.

* * * * *